US006734633B2

(12) United States Patent
Matsuba et al.

(10) Patent No.: US 6,734,633 B2
(45) Date of Patent: May 11, 2004

(54) BULB-FORM LAMP AND MANUFACTURING METHOD OF LAMP CASE

(75) Inventors: Tetsuo Matsuba, Takatsuki (JP); Shinichiro Ishitsuka, Takatsuki (JP); Masato Kawase, Ohtsu (JP); Tsuneo Miyata, Ohtsu (JP); Tomotaka Arikawa, Ohtsu (JP); Takenori Shibata, Takatsuki (JP); Haruyuki Hirokawa, Takatsuki (JP)

(73) Assignees: Matsushita Electronics Corporation, Osaka (JP); Shinsei Kagaku Kogyo Co., Ltd., Shiga-ken (JP)

( * ) Notice: Subject to any disclaimer, the term of this patent is extended or adjusted under 35 U.S.C. 154(b) by 9 days.

(21) Appl. No.: 09/814,961

(22) Filed: Mar. 23, 2001

(65) Prior Publication Data

US 2001/0024080 A1 Sep. 27, 2001

(30) Foreign Application Priority Data

Mar. 27, 2000 (JP) ..... 2000-086593

(51) Int. Cl.[7] ..... H01J 13/46
(52) U.S. Cl. ..... 315/58; 315/291; 439/615
(58) Field of Search ..... 315/58, 151, 156, 315/158, 209 R, 246, 291; 313/318.01, 623; 439/615, 339

(56) References Cited

U.S. PATENT DOCUMENTS

| | | | | |
|---|---|---|---|---|
| 4,739,222 A | | 4/1988 | Nomoto et al. | 315/57 |
| 4,934,951 A | | 6/1990 | Schonath | 439/86 |
| 5,744,913 A | * | 4/1998 | Martich et al. | 315/158 |
| 5,828,185 A | * | 10/1998 | Fellows et al. | 315/246 |
| 6,172,452 B1 | * | 1/2001 | Itaya et al. | 313/490 |
| 6,252,357 B1 | * | 6/2001 | Tanaka et al. | 315/209 R |
| 6,488,538 B1 | * | 12/2002 | Matsuba et al. | 439/615 |
| 6,547,582 B2 | * | 4/2003 | Matsuba et al. | 439/339 |

FOREIGN PATENT DOCUMENTS

| | | | | |
|---|---|---|---|---|
| EP | 0 005 626 A1 | | 11/1979 | |
| EP | 0 902 605 A1 | | 3/1999 | |
| EP | 1139388 A1 | * | 10/2001 | H01J/61/32 |
| JP | 56-96566 | | 7/1981 | |
| JP | 64-89140 | | 4/1989 | |
| JP | 2-119342 | | 9/1990 | |
| JP | 05299060 | | 11/1993 | |
| JP | 07186186 | | 7/1995 | |
| JP | 10335029 | | 12/1998 | |
| WO | WO 96/13048 | | 5/1996 | |

* cited by examiner

*Primary Examiner*—Don Wong
*Assistant Examiner*—Jimmy T Vu
(74) *Attorney, Agent, or Firm*—Fitch, Even, Tabin & Flannery

(57) ABSTRACT

In a bulb-form lamp, a threaded portion 31 of a lamp cap 5, that is, a shell 30 is made of a conductive resin. The conductive resin shell 30 and an eyelet 50 constituting the lamp cap 5 are composite parts, which are molded integrally with a lamp case 20. A part of the conductive resin shell 30 is provided with a terminal connective portion 30*a* projecting into the lamp case 20. The terminal connective portion 30*a* is connected with an electrode terminal 40 led out of a printed circuit board 13 of a lighting circuit 14 so that the conductive resin shell 30 and the lighting circuit 14 are electrically connected. By doing so, it is possible to simplify the assembly of bulb-form lamp, and to reduce an assembly cost, and further, to manufacture a bulb-form lamp having a high quality and a lamp case for the bulb-form lamp.

17 Claims, 13 Drawing Sheets

BULB-FORM LAMP AND MANUFACTURING METHOD OF LAMP CASE

BACKGROUND OF THE INVENTION

The present invention relates to a bulb-form lamp and a manufacturing method of a lamp case, and more particular, to a bulb-form lamp, which is constructed in a manner that a threaded portion of a lamp cap for making an electrical connection with a lighting circuit of the bulb-form lamp is formed out of a conductive resin.

For example, as a conventional bulb-form lamp, there is a compact self-ballasted fluorescent lamp. The compact self-ballasted fluorescent lamp is constructed in the following manner. More specifically, as shown in FIG. 13, an envelope 91 comprises a glass glove 11 and a lamp case 25. Further, an arc tube 10, a printed circuit board 13 on which a lighting circuit 14, and two lead wires 15*a* and 15*b* connected to the lighting circuit 14 so as to supply a power are received in the envelope 91.

A lamp cap 5 is screwed onto one end portion of the lamp case 25 so that the lamp case 25 is prevented from loosening by caulking or the like. The lamp cap 5 comprises a metal shell 5*c* forming a threaded portion 53, and an eyelet 5*a* fixed by pouring an eyelet glass 5*b* functioning as an insulator into the distal end portion of the metal shell 5*c*. The metal shell 5*c* and the eyelet 5*a* are integrated with each other. These metal shell 5*c* and eyelet 5*a* constitute an electrode for supplying a power to the lighting circuit 14.

The eyelet 5*a* consists mainly of Ni (nickel) plating brass. One lead wire 15*a* is let from a central hole 52 of the eyelet 5*a* to the outside, and then, is connected to the outer surface of the eyelet 5*a* by soldering. In this case, although is not shown, there is the case where the lead wire 15*a* and the eyelet 5*a* are connected by plasma arc welding using no solder in the light of environmental protection.

On the other hand, the metal shell 5*c* consists of metal such as Ni plating brass, aluminum or the like. The other lead wire 15*b* is led from the rear end portion of the metal shell 5*c* to the outside, and then, is connected to the outer surface of the metal shell 5*c* by soldering. In this case, although is not shown, there is the case where the lead wire 15*b* and the metal shell 5*c* are connected by resistance welding or TIG welding in the light of environmental protection.

The following is a description on a manufacturing method of the conventional bulb-form lamp as described above.

First, an arc tube 10 is assembled to a holder 12, and thereafter, is fixed by a silicon bonding agent or the like. A printed circuit board 13 is fixed with respect to the holder 12 fixing the arc tube 10 on the side opposite to the mounted arc tube 10. Thereafter, the lamp case 25 is fitted into the holder 12 mounting the arc tube 10 and the printed circuit board 13. A silicon bonding agent or the like is filled into a circular-arc gap formed at a portion where the lamp case 25 is fitted into the holder 12, and subsequently, the glove 11 is inserted and fixed into the circular-arc gap filled with the bonding agent. Then, the silicon bonding agent filled into the circular-arc or the like is dried and hardened in a high temperature furnace, and thereby, the lamp case 25 and the glove 11 is fully assembled with respect to the holder 12.

Next, the lamp cap 5 is screwed into the distal end portion of the lamp case 25, and subsequently, the lamp case 25 is fixed by caulking. In the case of assembling the lamp cap 5 to the lamp case 25, the lead wire 15*a* is led out of the central hole 52 of the eyelet 5*a* while the lead wire 15*b* is led out of the proximal portion of the metal shell 5*c*.

Thereafter, the led-out portion of the lead wire 15*b* is connected to the outside of the metal shell 5*c* by soldering or resistance welding and TIG welding. Likewise, the lead wire 15*a* led out of the central hole 52 of the eyelet 5*a* is connected to the outside of the eyelet 5*a* by soldering or plasma arc welding.

In the manner as described above, the bulb-form lamp shown in FIG. 13 is completed.

By the way, in the above conventional bulb-form lamp, the lamp case 25 is independently molded out of a resin, and the lamp cap 5 is manufactured by an exclusive maker in a manner that the eyelet 5*a* and the metal shell 5*c* are fixed by the eyelet glass 5*b*. For this reason, in order to assemble the lamp cap 5 into the lamp case 25, the following various processes must be carried out; more specifically, when manufacturing the bulb-form lamp, the lamp cap 5 is inserted and screwed into the lamp case 25, and thereafter, is fixed by caulking. As a result, many working processes (man-hour) are required.

Further, when screwing the lamp cap 5, in the case where the threaded portion 53 of the metal shell 5*c* is strongly griped by an automatic machine, there is a possibility that the threaded portion 53 is deformed, and the eyelet glass 5*b* breaks or cracks.

Furthermore, in the case where caulking with respect to the lamp cap 5 is insufficient, the lamp cap 5 looses and comes off; conversely, in the case where caulking is too strong, there is a possibility that the lamp case 25 is broken. For this reason, it is difficult to control a caulking strength.

SUMMARY OF THE INVENTION

The present invention has been made in view of the above problems. It is, therefore, an object of the present invention to provide a bulb-form case, which can simplify an assembly of the bulb-form case so as to reduce an assembly cost, and has a high quality, and to provide a manufacturing method of a lamp case.

In order to solve the above problem, the present invention provides the following technical means. More specifically, according to one aspect, the present invention provides a bulb-form lamp comprising: an arc tube; a lighting circuit for lighting the arc tube; a lamp case receiving the lighting circuit; and a lamp cap mounted outside the lamp case and functioning as an electrode of the lighting circuit, a threaded portion of the lamp cap, that is, a shell being made of a conductive resin.

According to the present invention, the conductive resin shell functions as an electrode for supplying a power to the lighting circuit like the conventional metal shell. Moreover, in general, the conductive resin has a hardness lower than metal; therefore, it is possible to improve a combined strength in which the conductive resin shell is engaged with a male-threaded portion of socket when using the bulb-form lamp.

In the technical means of the present invention, the conductive resin shell is a composite part, which is molded integrally with the lamp case. By doing so, there is no need of carrying out processes for inserting the lamp cap into the lamp case, screwing, and caulking when assembling the bulb-form lamp like the conventional case. Therefore, it is possible to prevent a deformation of threaded portion by the assembling work, and no problem arises such that caulking is insufficient with respect to the lamp cap; for this reason, the lamp cap looses and comes off.

In the technical means of the present invention, the conductive resin shell and an eyelet constituting a distal portion of the lamp cap are composite parts, which are molded integrally with the lamp case. The resin portion of the lamp case is extended to an eyelet glass insulator of the conventional lamp cap, and thereby, there is no need of using the eyelet glass. Therefore, no problem arises such that the eyelet glass cracks like the conventional case.

In the technical means of the present invention, a part of the conductive resin shell is provided with a terminal connective portion projecting into the lamp case, and the terminal connective portion is connected with the lighting circuit so that the conductive resin shell and the lighting circuit are electrically connected. The lighting circuit is assembled to the lamp case so as to be connected with the terminal connective portion of the conductive resin shell, and thereby, the conductive resin shell and the lighting circuit are electrically connected. By doing so, the lead wire has no need to be soldered like the conventional case; therefore, there is no connection failure caused when the solder comes off in the shell portion.

In the technical means of the present invention, the terminal connective portion is connected with an electrode terminal led out of a printed circuit board of the lighting circuit. The terminal connective portion and the electrode terminal are connected, and thereby, it is possible to securely make an electrical connection of the conductive resin shell with the lighting circuit.

In the technical means of the present invention, a part of metal terminal buried in the conductive resin shell is exposed in the lamp case, and the part of metal terminal is connected with the lighting circuit so that the conductive resin shell and the lighting circuit are electrically connected. The lighting circuit is assembled to the lamp case so as to be connected to a part of the metal terminal buried in the conductive resin shell, and thereby, the conductive resin shell and the lighting circuit are electrically connected; therefore, the electrical connection between these can be securely made.

In the technical means of the present invention, a metal eyelet constituting a distal portion of the lamp cap may be fitted into a through hole formed at the lamp case distal portion. In this case, a process for assembling the eyelet to the lamp case is required; however, the same effect as above can be obtained.

Further, according to another aspect, the present invention provides a manufacturing method of a lamp case receiving a lighting circuit for lighting an arc tube of bulb-form lamp and having a lamp cap functioning as an electrode of the lighting circuit and mounted outside the lamp case, comprising the following steps of:

a primary process; and a secondary process, the primary process including the steps of:

closing a first cavity mold, which is formed along an outer profile of the lamp case and is provided with a protrusion at a shell of being a threaded portion of the lamp cap, and a core mold, which is formed along an inner profile of the lamp case and is provided with a recess portion capable of inserting the protrusion;

forming a cylindrical cavity along the profile of the lamp case;

injecting a molten resin into the cylindrical cavity; and forming a primary molding, which is formed with a hole leading electrode by the protrusion, the secondary process including the steps of:

opening the dies;

fitting a second cavity mold provided with a threaded cylinder forming surface into the core mold holding the primary molding;

forming a threaded cylinder cavity including the hole leading electrode at an outer peripheral surface of the shell; and injecting a molten conductive resin into the threaded cylinder cavity so that a part of the conductive resin is molded integrally with a shell, which is provided with a terminal connective portion projected into the lamp case, via the hole.

According to the present invention, the above primary and secondary processes are carried out, and thereby, the lamp case molded integrally with the shell is obtained; therefore, there is no need of carrying out a process for assembling the lamp cap to the lamp case like the conventional case. Moreover, the lighting circuit is assembled to the lamp case so as to be connected to the terminal connective portion of the conductive resin shell, and thereby, the conductive resin shell and the lighting circuit are electrically connected; therefore, the assembly of the lighting circuit can be readily made.

Furthermore, according to another aspect, the present invention provides a manufacturing method of a lamp case receiving a lighting circuit for lighting an arc tube of bulb-form lamp and having a lamp cap functioning as an electrode of the lighting circuit and mounted outside the lamp case, comprising the following steps of:

a primary process;

a terminal insertion process; and a secondary process, the primary process including the steps of:

closing a first cavity mold, which is formed along an outer profile of the lamp case and is provided with a protrusion at a shell of being a threaded portion of the lamp cap, and a core mold, which is formed along an inner profile of the lamp case and is provided with a recess portion capable of inserting the protrusion;

forming a cylindrical cavity along the profile of the lamp case;

injecting a molten resin into the cylindrical cavity; and forming a primary molding which is formed with an electrode leading hole by the protrusion, the terminal insertion process including the steps of:

opening the dies; and inserting a metal terminal into the electrode leading hole of the primary molding so that the metal terminal is inserted and fixed into a recess portion of the core mold, the secondary process including the steps of:

fitting a second cavity mold provided with a threaded cylinder forming surface into the core mold holding the primary molding;

forming a threaded cylinder cavity including a part of the metal terminal at an outer peripheral surface of the shell;

injecting a molten conductive resin into the threaded cylinder cavity so that a part of the metal terminal is molded integrally with a shell, which is provided with a terminal connective portion projected into the lamp case, via the electrode leading hole.

According to the present invention, likewise, there is no need of carrying out a process for assembling the lamp cap to the lamp case. Moreover, the lighting circuit is assembled to the lamp case so as to be connected to the metal terminal of the conductive resin shell, and thereby, the conductive resin shell and the lighting circuit are electrically connected; therefore, the assembly of the lighting circuit can be readily made.

In the technical means of the present invention, the primary process further includes a step of forming a through hole capable of fitting an eyelet constituting the distal portion of the lamp cap therein at the distal portion of the primary molding, and forming a recess portion for preventing the eyelet from coming off at the surroundings of the through hole. There is no need of forming the portion for mounting the eyelet by using an eyelet glass; therefore, the number of processes can be reduced.

In the technical means of the present invention, the primary and secondary processes are carried out by a two color molding process.

As described above, according to the present invention, the eyelet of the lamp cap and the conductive resin shell are molded integrally with the lamp case, and thereby, there is no possibility that the lamp cap looses and comes out of the lamp case. Moreover, when manufacturing the bulb-form lamp, there is no need of processes for inserting the lamp cap into the conventional lamp case, and fixing it by caulking. Therefore, it is possible to greatly reduce the number of assembling processes, and to reduce the assembly cost for the bulb-form lamp. Further, no problem arises such that the shell is deformed by caulking and the eyelet glass cracks; therefore, it is possible to manufacture a bulb-form lamp having a high quality.

DETAILED DESCRIPTION OF THE PREFERRED EMBODIMENTS

The preferred embodiment of the present invention will be described below with reference to the accompanying drawings.

(Bulb-form lamp)

Figure 1:
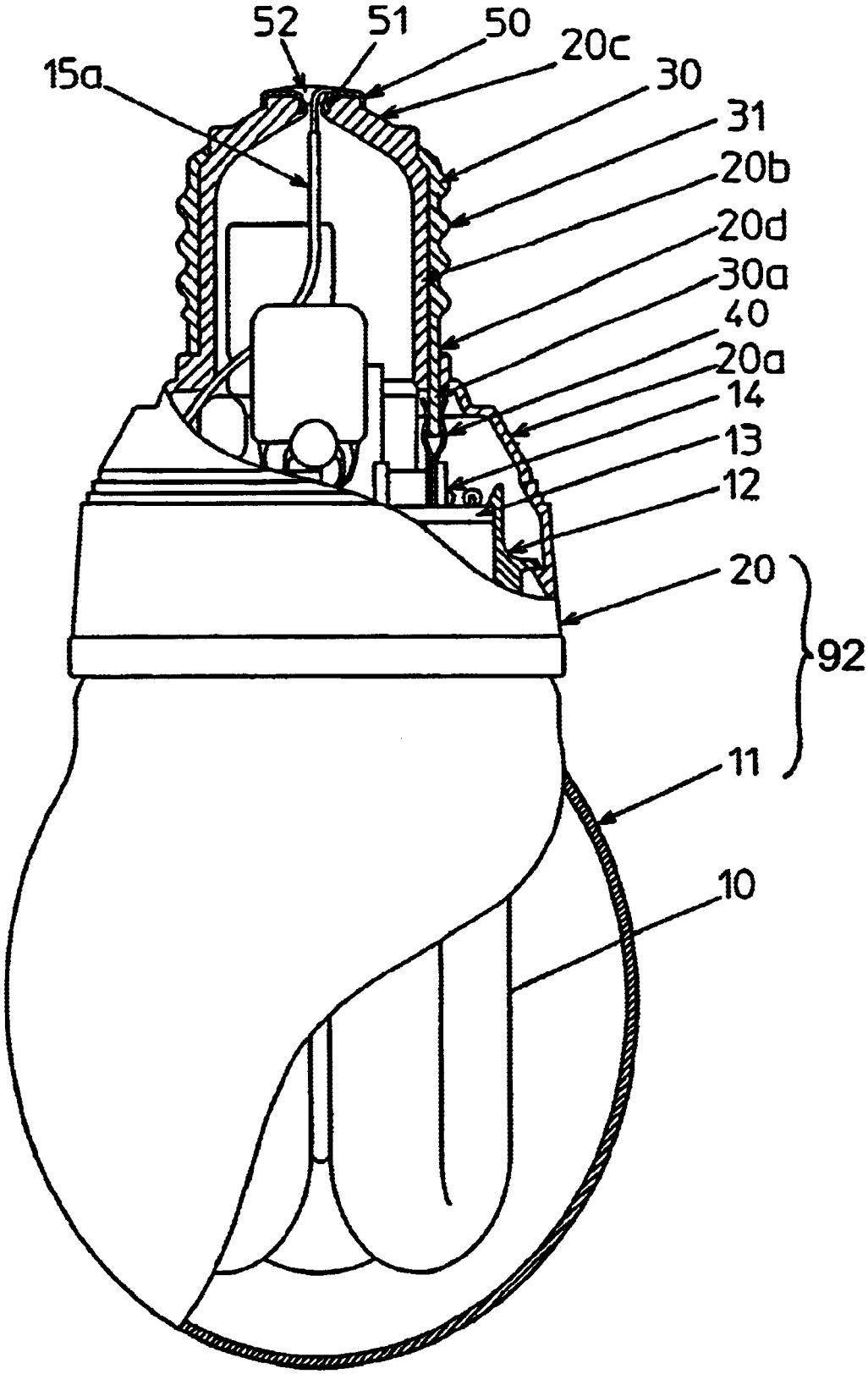
FIG. 1 is a front view in partially in section showing a compact self-ballasted fluorescent lamp according to one embodiment of the present invention.

One embodiment of the present invention relates to a compact self-ballasted fluorescent lamp having a rated power of 13 watt, an entire length of 120 mm and the maximum outer diameter of 60 mm. As shown in FIG. 1, a fluorescent tube 10 and a lighting circuit 14 of the fluorescent tube 10 are received in an envelope 92 comprising a glove 11 and a lamp case 20. The fluorescent tube 10 and the lighting circuit 14 are mounted to a printed circuit board 13. These fluorescent tube 10 and lighting circuit 14 are assembled into the envelope 92 in the following manner. More specifically, the printed circuit board 13 is held by a holder 12, and the holder 12 is held in the lamp case 20 of the envelope 92. The glove 11 is made of a glass or resin having translucence.

In the fluorescent tube 10, three U-shaped tubes having an outer diameter of 11 mm are bridge-connected so as to form one discharge path. Further, in the fluorescent tube 10, its one end portion, that is, an electrode terminal side is mounted to the printed circuit board 13. In addition, the fluorescent tube 10 is received in the glove 11.

The lighting circuit 14 is mounted to the side opposite to the fluorescent tube 10 in the printed circuit board 13. Further, the lighting circuit 14 is received in the lamp case 20. For this reason, a lead wire 15*a* and an electrode terminal 40 are led out of the lighting circuit 14 so that a power is supplied to the lighting circuit 14 via the lead wire 15*a* and the electrode terminal 40.

The lamp case 20 is composed of an bowl-like portion 20*a* holding the holder 12, a cylinder portion 20*b* continuously formed from the bowl-like portion 20*b*, and a distal portion 20*c* continuouslyformedfromthecylinderportion20*b*. For example, the lamp case consists of resin moldings such as polyethylene terephthalate (PET), polybutylene terephthalate (PBT) or the like.

The cylinder portion 20*b* of the lamp case 20 is formed with a conductive resin shell 30, which functions as one electrode for supplying a power to the lighting circuit 14, at its outer periphery. The conductive resin shell 30 is formed into a shape of cylinder having a threaded portion 31, and is molded integrally with the lamp case 20. The following composite conductive material is used as the conductive resin forming the conductive resin shell 30. More specifically, in order to give a conductive property, the composite conductive material is prepared in the following manner of mixing conductive materials such as carbon black, metal fiber, carbon fiber, metal flake, metallized glass beads, metallized glass fiber, organic polymer, in polymeric materials such as PBT, PPS or polymer of PBT and AS.

An electrode leading hole 20*d* is formed between the cylinder portion 20*b* and the bowl-like portion 20*a* of the lamp case 20. A part of the conductive resin of the conductive resin shell 30 is extended from the electrode leading hole 20*d* so as to constitute a terminal connective portion 30*a* exposed in the lamp case 20. The terminal connective portion 30*a* is connected to the electrode terminal 40 led out of the printed circuit board 13 so that the conductive resin shell 30 and the lighting circuit 14 are electrically connected.

The electrode terminal 40 mounted to the printed circuit board 13 is formed into a shape of clip as shown in FIG. 1 so that the terminal connective portion 30*a* extending from the conductive resin shell 30 is nipped in the clip-like electrode terminal 40. By doing so, there is no need of leading the lead wire 15*b* to the outside of the lamp case 25, and soldering the lead wire 15*b* thus led, like the conventional bulb-form lamp shown in FIG. 13; therefore, the number of processes is reduced. Accordingly, the lighting circuit 14 can be readily assembled to the lamp case 20. Further, like the conventional case, in the case where soldering is performed outside the envelope 91, solder comes off due to soldering failure and aged deterioration; for this reason, there is a possibility of causing a connection failure of the lighting circuit 14 and the shell 5*c*. On the contrary, according to the present invention, in the lamp case 20, the terminal connective portion 30*a* contacts with the electrode terminal 40; therefore, no problem arises like the conventional case. In this case, the electrical connection of the terminal connective portion 30*a* with the electrode terminal 40 may be made by only contacting with each other. For example, the terminal connective portion 30*a* with the electrode terminal 40 may be bonded by using a conductive bonding agent (adhesive).

Moreover, the distal portion 20*c* of the lamp case 20 is mounted with an eyelet 50, which functions as the other electrode for supplying a power to the lighting circuit 14. The eyelet 50 consists mainly of metal such as Ni plating brass or the like. Further, the eyelet 50 is formed into a shape of cone, and is integrally molded in injection molding of the lamp case 20. The metallic and conical eyelet 50 is formed with a central hole 52 corresponding to a through hole formed in the distal portion 20*c* of the lamp case 20. Moreover, the eyelet 50 is formed with a downwardly projected engaging portion 51. The projected engaging portion 51 is buried in the distal portion 20*c* of the lamp case 20. The lead wire 15*a* led from the printed circuit board 13 is led to the outside via the through hole of the lamp case distal portion 20*c* and the central hole 52 of the eyelet 50, and thereafter, soldered to the outer surface of the eyelet 50, and thereby, the eyelet 50 is electrically connected with the lighting circuit 14. In this case, the eyelet 50 and the lead wire 15*a* may be connected by plasma arc welding (not shown), in addition to soldering.

(Assembly of bulb-form lamp)

Next, the following is a brief description on an assembling method of the bulb-form lamp of the above embodiment.

The glove 11, the lamp case 20, the printed circuit board 13 including the fluorescent tube 10 and the lighting circuit 14, and the holder 12 are prepared.

First, the holder 12 holds the printed circuit board 13 mounting the fluorescent tube 10 and the lighting circuit 14, and then, in this state, the holder 12 is assembled into the lamp case 20. In this case, the holder 12 is assembled so that the clip type electrode terminal 40 nips the terminal connective portion 30*a* projected into the lamp case 20. Moreover, the lead wire 15*a* is led to the outside via the through hole of the lamp case distal portion 20*c* and the central hole 52 of the eyelet 50. Next, the glove 11 is fitted into the lamp case 20. Thereafter, the leadwire 15*a* led from the lamp case distal portion 20*c* is connected to the outer surface of the eyelet 50 by soldering or plasma arc welding. In this manner, the bulb-form lamp shown in FIG. 1 is completed.

Figure 13:
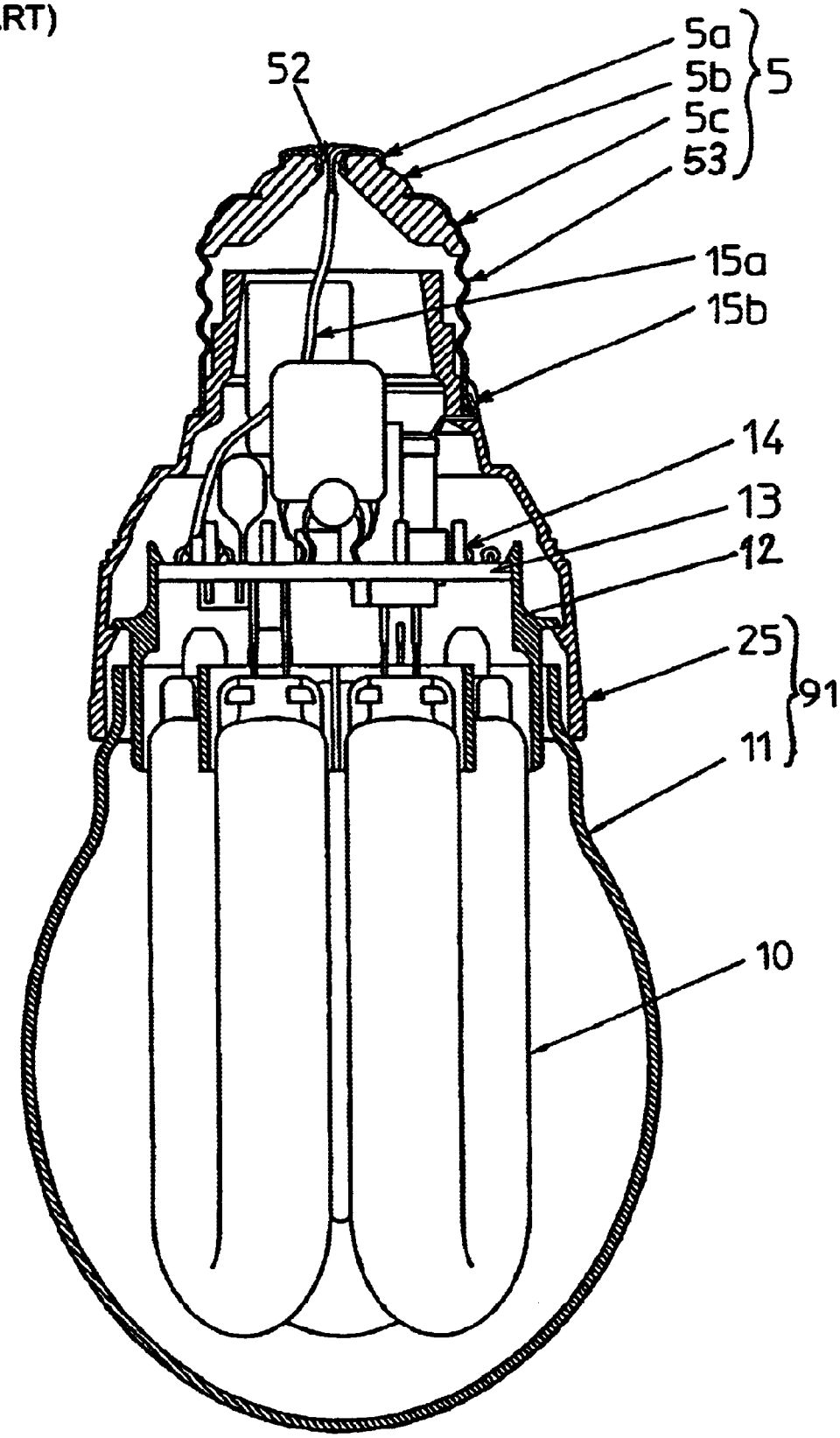
Fig. 13 (PRIOR ART)
FIG. 13 is a cross sectional view showing a conventional compact self-ballasted fluorescent lamp.

As is evident from the above description, in the bulb-form lamp of this embodiment, there is no need of carrying out various processes required for the conventional lamp shown in FIG. 13; more specifically, insertion of the lamp cap 5 into the lamp case 25, fixing by caulking, soldering of the lead wire 15*b*. Therefore, the bulb-form lamp is readily assembled, and the number of assembling processes is reduced, and further, no problem arises such that the threaded portion of the shell is deformed and the eyelet glass cracks by caulking. As a result, it is possible to greatly improve a quality of bulb-form lamp.

(Modification example of bulb-form lamp)

Figure 2:
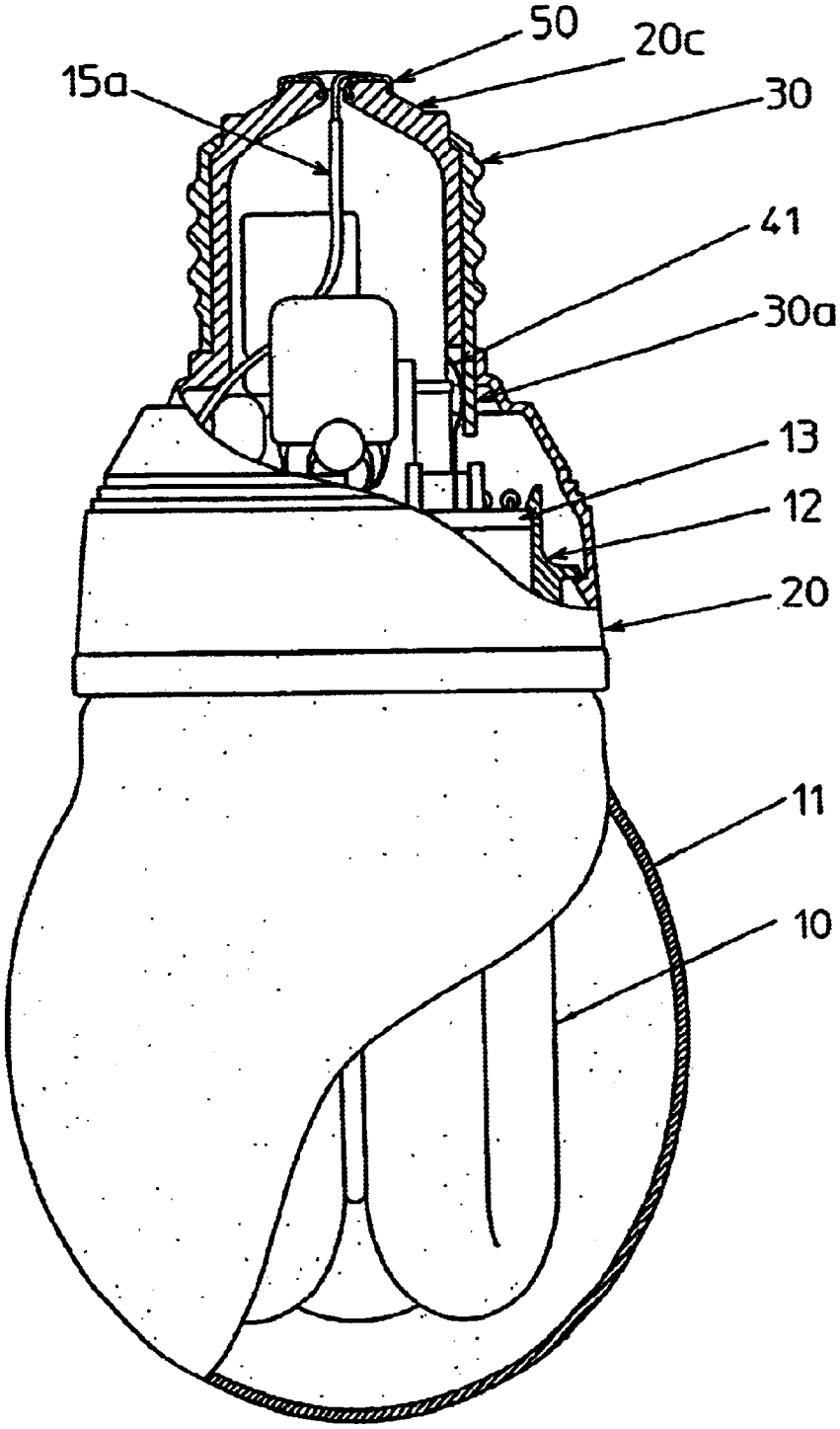
FIG. 2 is a front view in partially in section showing the compact self-ballasted fluorescent lamp according to one embodiment of the present invention.
Figure 3:
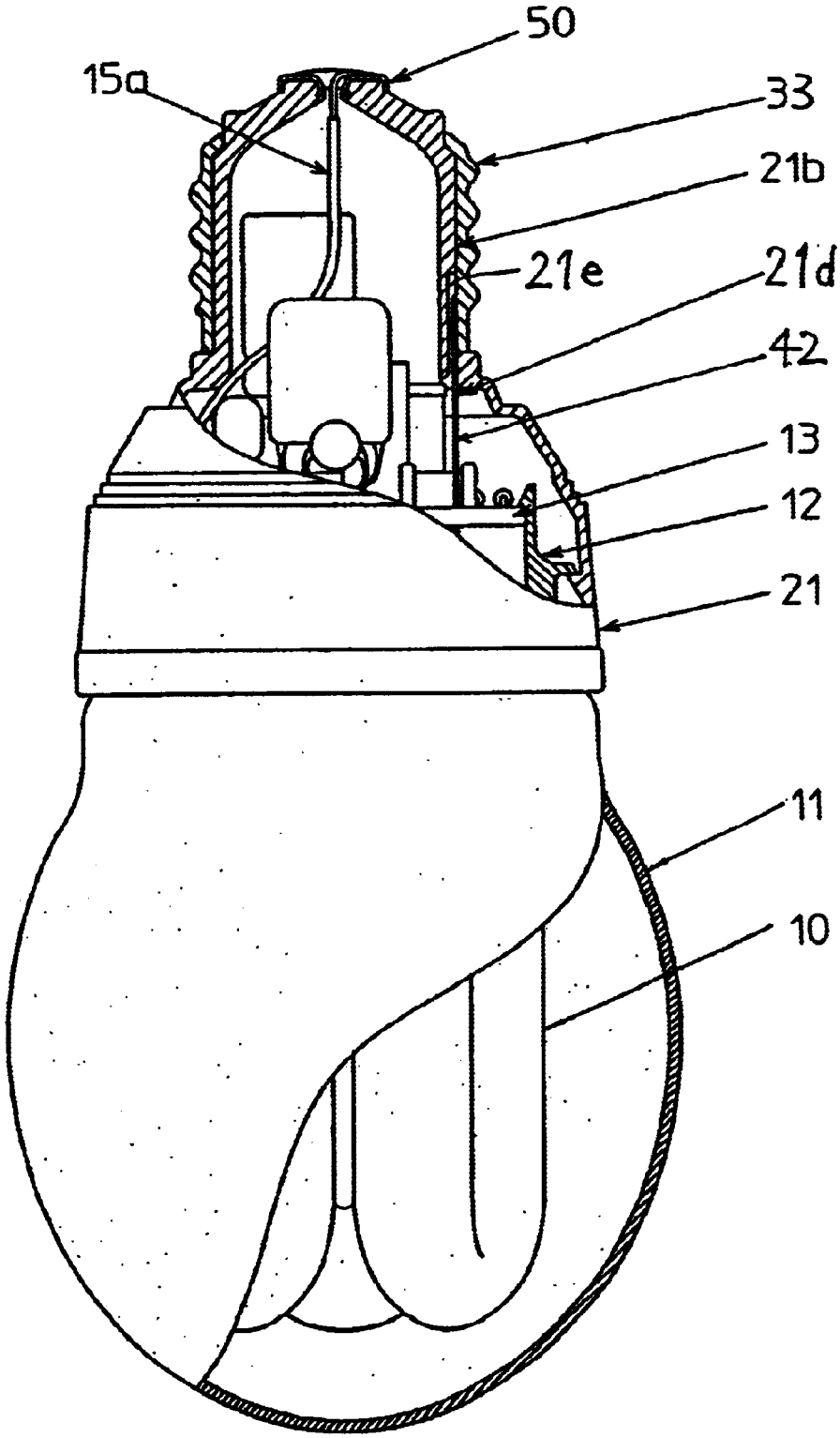
FIG. 3 is a front view in partially in section showing the compact self-ballasted fluorescent lamp according to one embodiment of the present invention.

In the above embodiment, the clip type electrode terminal shown in FIG. 1 has been used as the electrode terminal for making an electrical connection with the conductive resin shell 30. Besides, a plate spring type electrode terminal 41 as shown in FIG. 2 is used. The plate spring type electrode terminal 41 comes into contact with the terminal connective portion 30*a*, and thereby, an electrical connection may be made. The electrical connection of the plate spring type electrode terminal 41 with the terminal connective portion 30*a* may be made by only contact, or the former and the latter may be bonded to each other by a conductive adhesive. Moreover, as shown in FIG. 3, a conductive resin shell 33 is formed with no terminal connective portion 30*a*, and a cylinder portion 21*b* of a lamp case 21 is formed with a groove at its outer surface so that a gap 21*e* is defined between the cylinder portion 21*b* and the conductive resin shell 33. Then, an electrode terminal 42 extending from the printed circuit board 13 and having spring properties is arranged in the gap 21*e* via an electrode leading hole 21*d* of the lamp case 21. The electrode terminal 42 comes into contact with the conductive resin shell 33, and thereby, an electrical connection maybe made. The electrical connection of the electrode terminal 42 having spring properties with the connective resin shell 33 may be made by only contact, or the former and the latter may be bonded to each other by a conductive adhesive.

Figure 4:
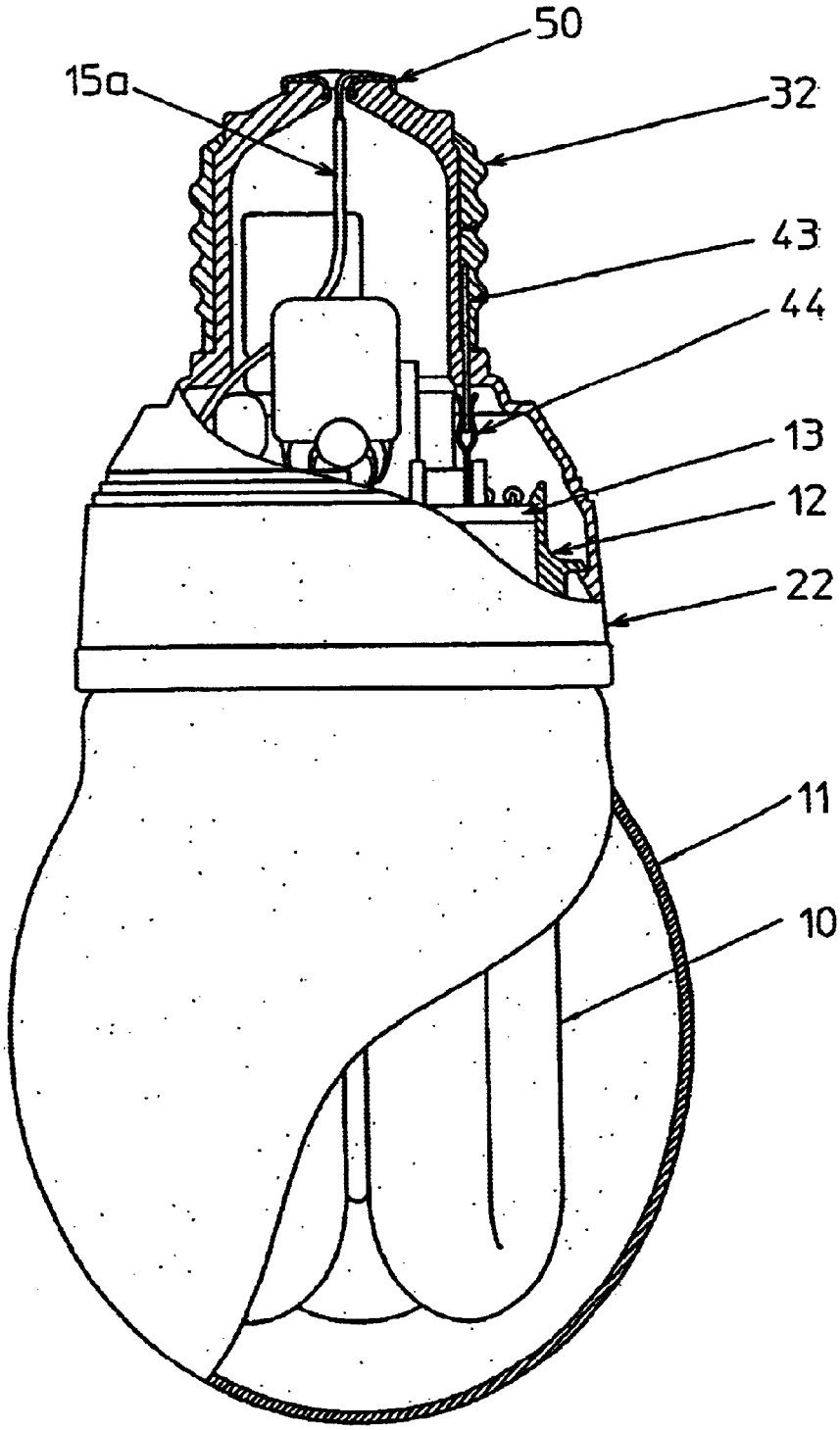
FIG. 4 is a front view in partially in section showing the compact self-ballasted fluorescent lamp according to one embodiment of the present invention.

The electrical connection of a conductive resin shell 30 with the lighting circuit 14 may be made in the following manner. More specifically, as shown in FIG. 4, one end portion of another metal terminal 43 is buried in the conductive resin shell 32, and then, the other end portion thereof is exposed in a lamp case 22. Further, the exposed metal terminal 43 is nipped into a clip type electrode terminal 44 (same as electrode terminal 45 shown in FIG. 6) led out of the printed circuit board 13, and thereby, the conductive resin shell 32 and the printed circuit board 13 may be electrically connected.

Figure 5:
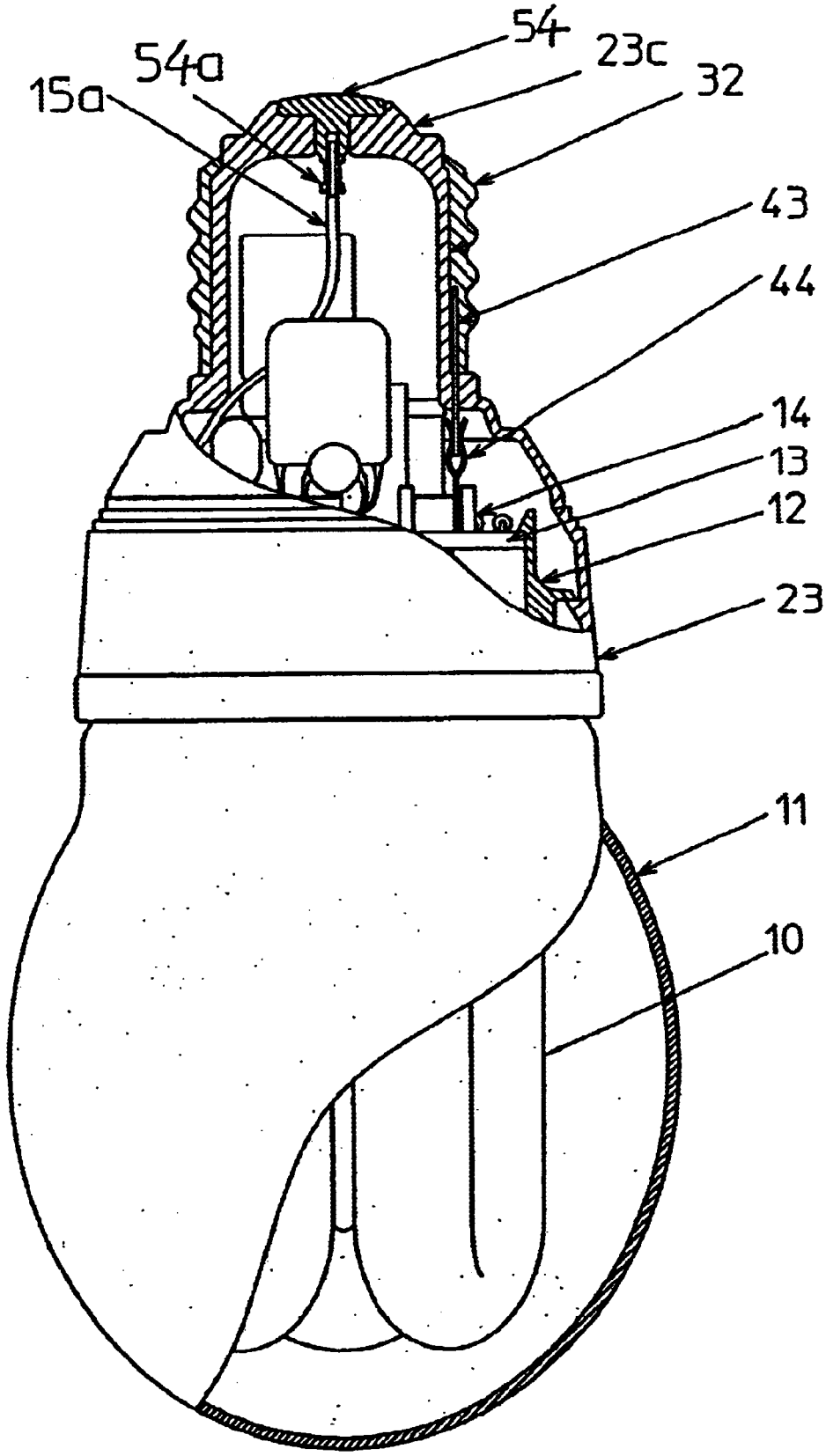
FIG. 5 is a front view in partially in section showing the compact self-ballasted fluorescent lamp according to one embodiment of the present invention.
Figure 6:
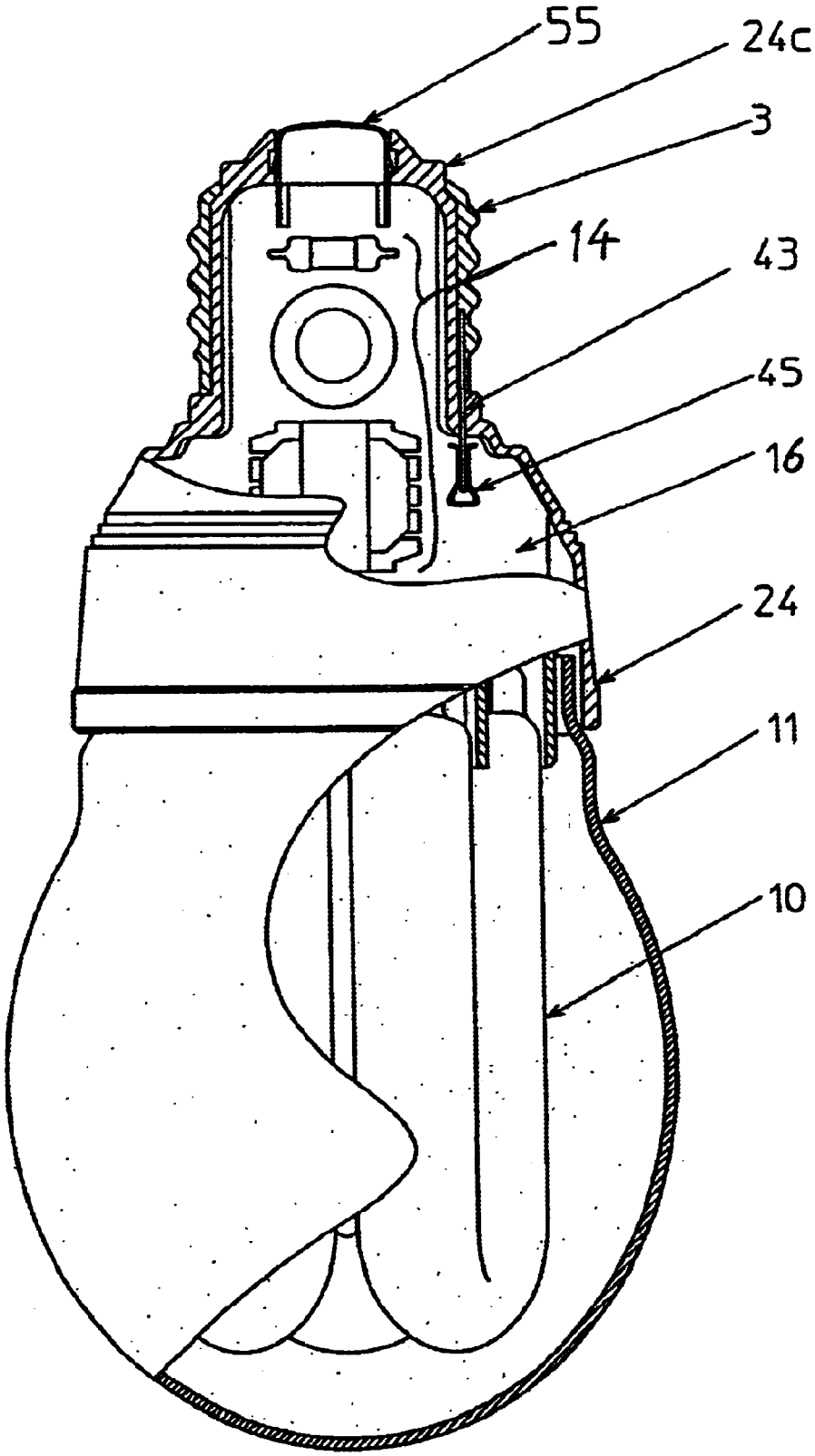
FIG. 6 is a front view in partially in section showing a compact self-ballasted fluorescent lamp according to one embodiment of the present invention.

Moreover, as shown in FIG. 5, a pushpin-shaped eyelet 54 may be used without molding the eyelet 50 integrally with the lamp case distal portion 20*c*, and only lamp case 23 and conductive resin shell 32 are integrally molded. Then, the lead wire 15*a* is led to the outside via a through hole of a lamp case distal portion 23*c*, and is welded after being inserted into a hole of the eyelet distal portion 54*a*. Thereafter, the eyelet 54 is arranged on the lamp case distal portion 23*c* so that the eyelet distal portion 54*a* is fitted into the through hole of the lamp case distal portion 23*c* while an outer peripheral portion of the eyelet 54 is engaged with a recess portion formed at the surroundings of the through hole. In this case, the eyelet 54 may be made of a material such as copper, in addition to brass used as the material for the eyelet 50 described before. Moreover, as shown in FIG. 6, an eyelet 55 having a U shape in its section is previously mounted to a printed circuit board 16 so as to be electrically connected to the lighting circuit 14. Then, when assembling the lighting circuit 14, the eyelet 55 may be inserted and fixed vertically to a portion from the interior of a lamp case 24 to the distal portion 24*c*. In this case, the eyelet 55 and the lighting circuit 14 are electrically connected without using a lead wire; therefore, there is no need of carrying out a process for soldering the lead wire. As a result, the assembly of bulb-form lamp can be more simplified. In addition, the material of the eyelet 55 is not limited to metal such as brass, copper or the like, and may be of course any other form so long as it is a moldable metal by plate work.

(Manufacturing method of lamp case)

Next, a manufacturing method of the lamp case 20 having the above structure will be described below with reference to FIG. 7 to FIG. 11. In this embodiment, the lamp case 20 is manufactured by a two color molding process. The two color molding process is a method of obtaining moldings in a manner of injecting two kinds of molten resin materials plasticized by two screws into one-side die having two cavities (hollow space) corresponding to a primary molding and a secondary molding.

Figure 7:
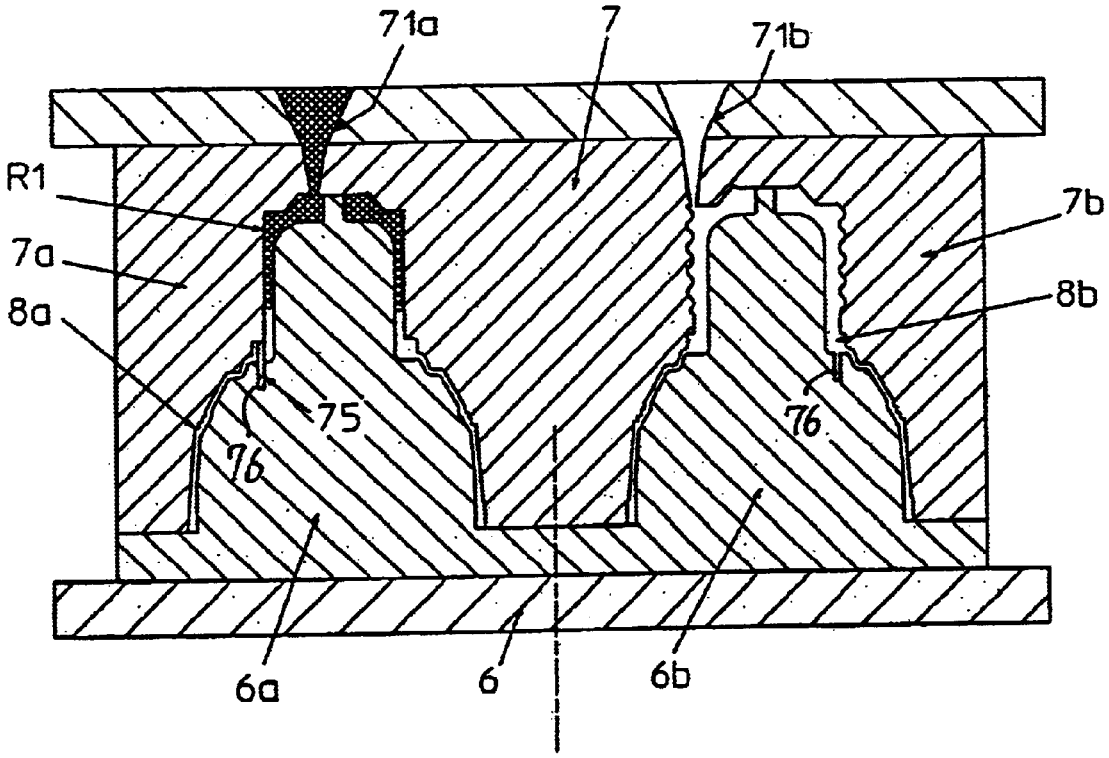
FIG. 7 is a cross sectional view showing a mold (die) clamping state in a resin molding primary process.

First, as shown in FIG. 7, a core die 6 and a cavity die 7 are closed. The core die 6 has a primary molding side core mold 6*a*, which is a main body of the lamp case 20, and a secondary molding side core mold 6*b* which is formed as a lamp case 20, and these core molds 6*a* and 6*b* have the same shape. On the other hand, the cavity die 7 has a primary molding side first cavity mold 7*a* and a secondary molding side second cavity mold 7*b*. By these molds, a primary molding side cavity 8*a* and a secondary molding side cavity 8*b* are formed.

Figure 8:
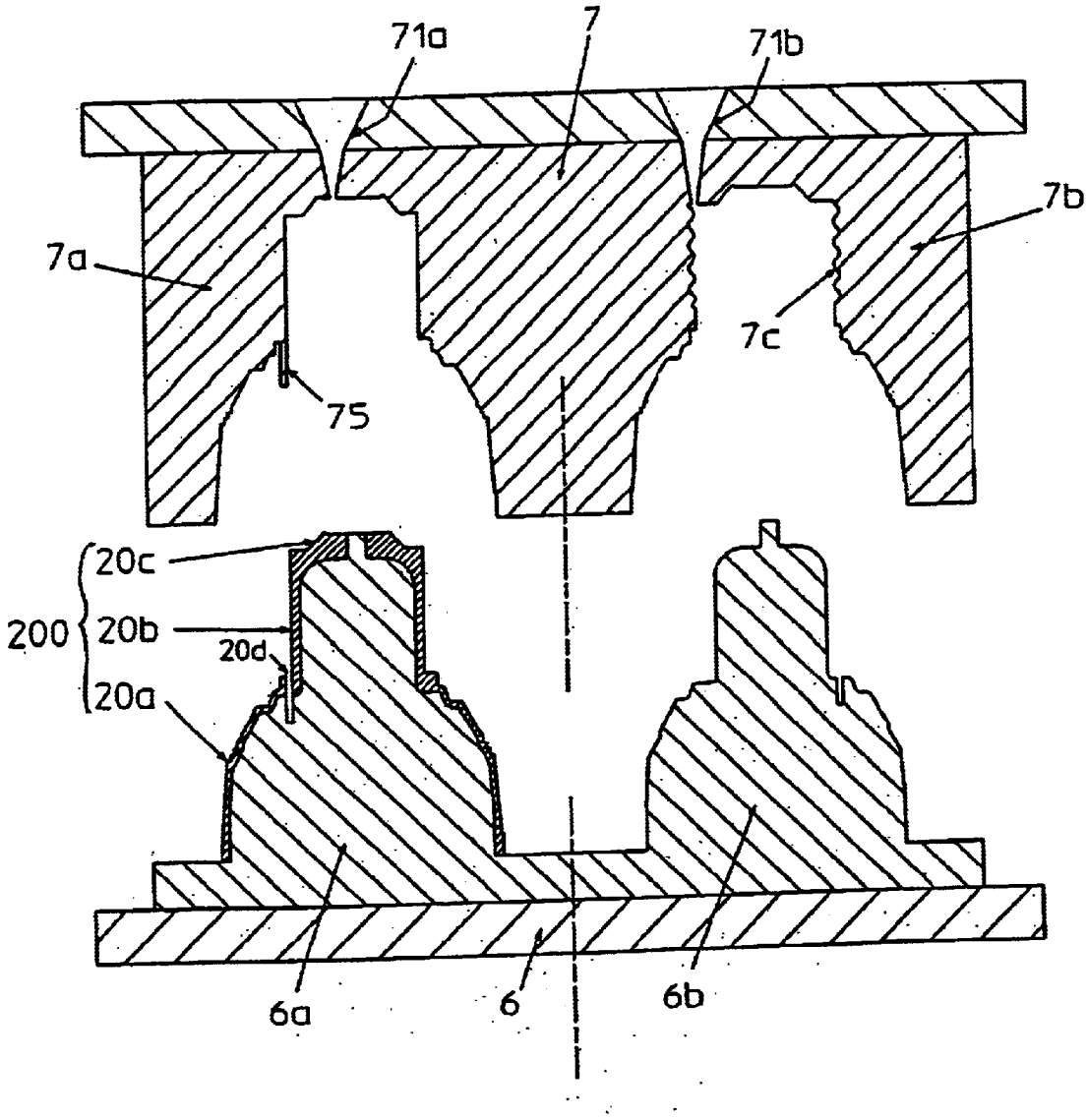
FIG. 8 is across sectional view showing a mold (die) opening state in the resin molding primary process.

Moreover, the primary molding side first cavity mold 7*a* is provided with a protrusion 75 for molding the electrode leading hold 20*d* and the terminal connective portion 30*a* in a primary molding 200 (lamp case 20 which is not still molded with conductive resin shell 30: see FIG. 8). The core molds 6*a* and 6*b* are individually formed with a recess portion 76 capable of inserting the protrusion 75. The cavity die 7 is formed with nozzles 71*a* and 71*b* respectively communicating with the cavities 8*a* and 8*b*. These nozzles 71*a* and 71*b* are individually connected to two cylinders included in an injection unit (not shown). As shown in FIG. 7, in order to carry out a primary process, that is, to mold a primary molding 200, the molten resin material R1 is injected from the injection unit (not shown) via the nozzle 71*a*, and then, is filled into to the cavity 8*a*. In FIG. 7, there is shown a first molding cycle, no molten resin material is injected from the secondary molding side nozzle 71*b*. When the molten resin material RI filled into the cavity 8*a* is cooled and hardened, the following primary molding 200 is manufactured, which has a bowl-like portion 20*a*, a cylinder portion 20*b* and a distal portion 20*c*, and is formed with an electrode leading hole 20*d* between the bowl-like portion 20*a* and the cylinder portion 20*b* (see FIG. 8).

Next, as shown in FIG. 8, in a secondary process, first, the die is opened. In this case, the primary molding formed by the core mold 6*a* is intactly held on the core mold 6*a* without being ejected. In this state, the core die 6 is rotated by an angle of 180°.

Figure 9:
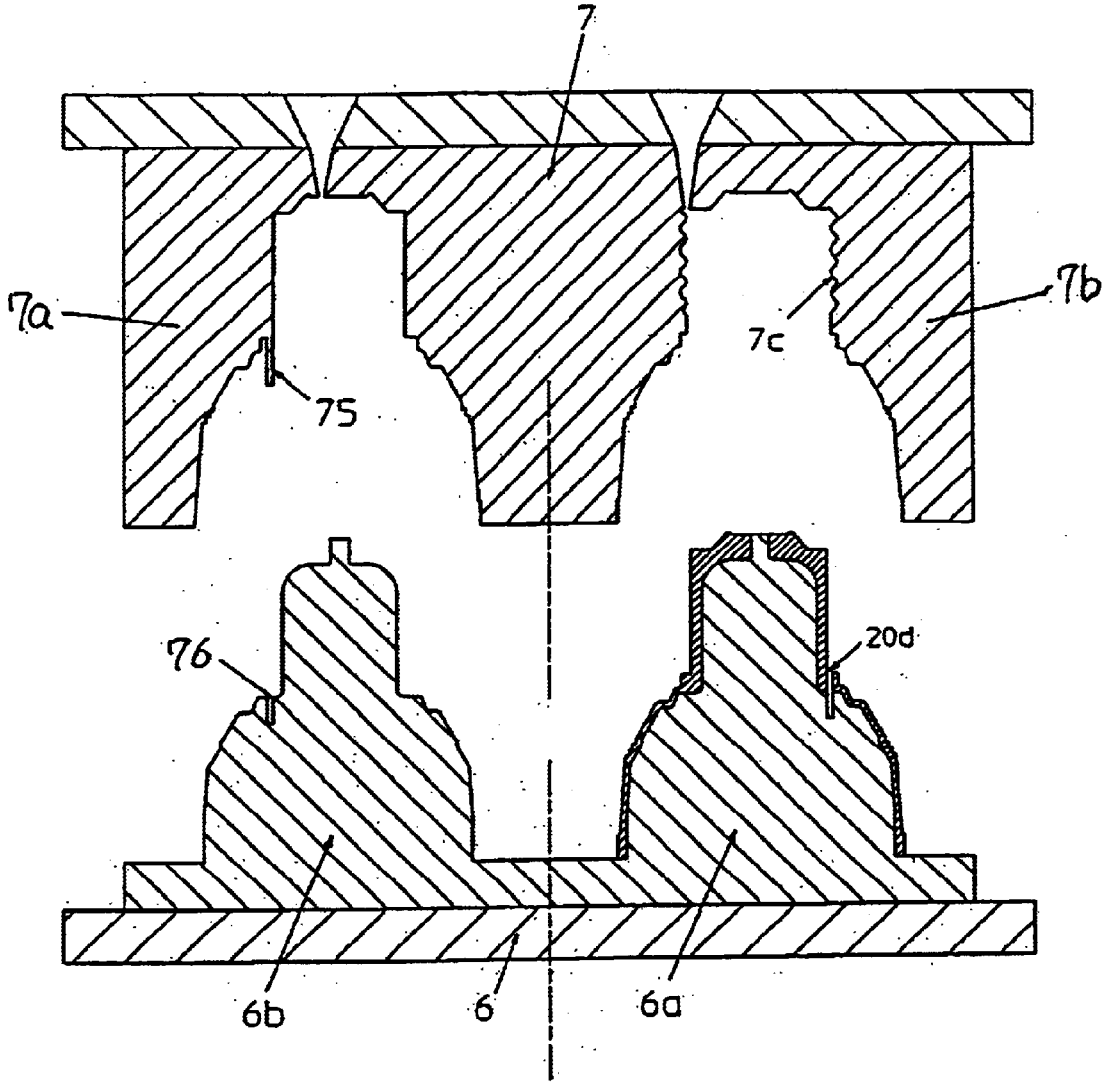
FIG. 9 is a cross sectional view showing a state when a core die is rotated by an angle of 180°.

By doing so, as shown in FIG. 9, the core mold 6*a* holding the primary molding 200 is arranged on a position corresponding to the other second cavity mold 7*b*. The second cavity mold 7*b* has a threaded cylinder forming surface 7*c* in which a part of mold surface is formed into a threaded shape.

Figure 10:
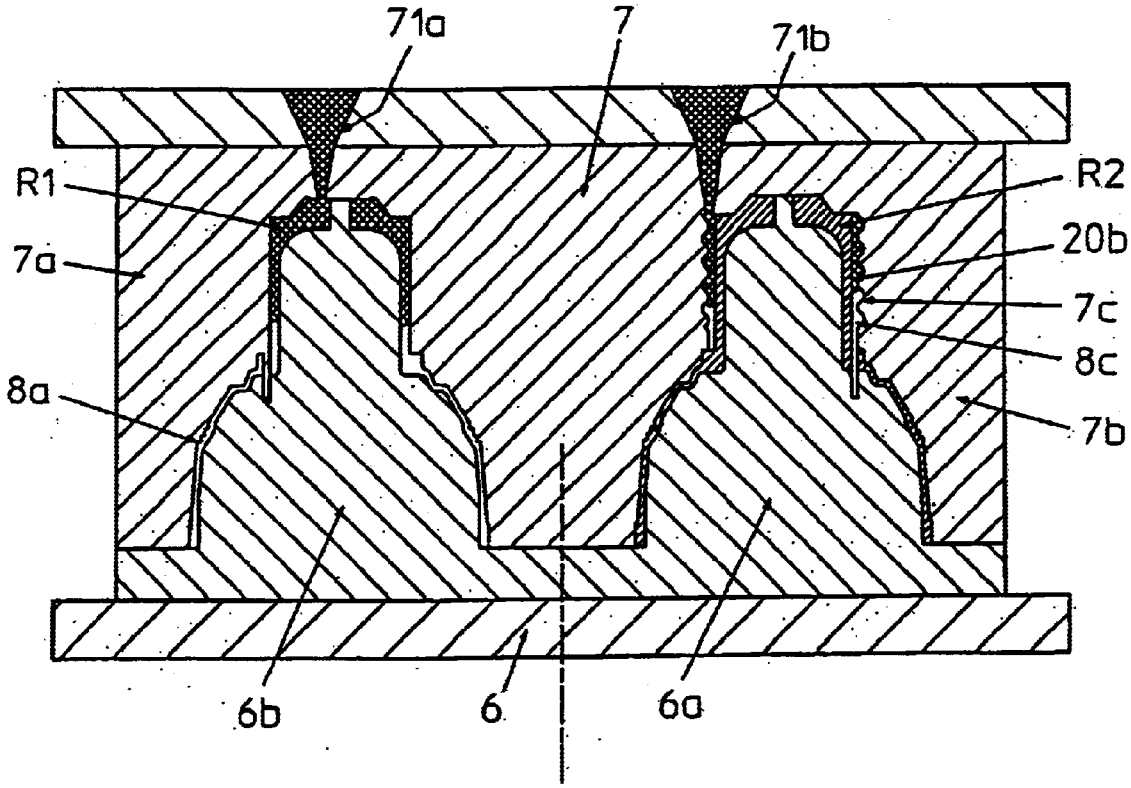
FIG. 10 is a cross sectional view showing a mold clamping state in a resin molding secondary process.

Subsequently, as shown in FIG. 10, when the dies are closed, the second cavity mold 7*b* is fitted into the core mold 6*a* holding the primary molding 200. By doing so, a threaded cylinder cavity 8*c* including the electrode leading hole 20*d* is formed at the outer peripheral surface of the cylinder portion 20*b* of the primary molding 200 by the threaded cylinder forming surface 7*c* of the second cavity mold7*b*. Simultaneously, the first cavity mold 7*a* is fitted into the other core mold 6*b* so that a cavity 8*a* corresponding to the primary molding 200 is formed. Then, a conductive resin, that is, a molten resin material R2 is injected to the cavity 8*a* from the injection unit (not shown) via another nozzle 71*b*, and thereafter, themoltenresinmaterialR2 is filled into the cavity 8*c*. By doing so, the conductive resin is filled into the electrode leading hole 20*d*. When the filled molten resin material R2 is cooled and hardened, a conductive resin shell 30 is molded integrally with the outer peripheral surface of the cylinder portion 20*b*. The conductive resin shell 30 thus molded has a threaded portion 53 at the outer periphery, and a terminal connective portion 30*a* whose part is exposed in the primary molding 200 (see FIG. 11). Moreover, the molten resin material R1 is injected to the cavity 8*a* formed by the other core mold 6*b* and the first cavity mold 7*a* from the nozzle 71*a*, and thus, the primary molding 200 is manufactured.

Figure 11:
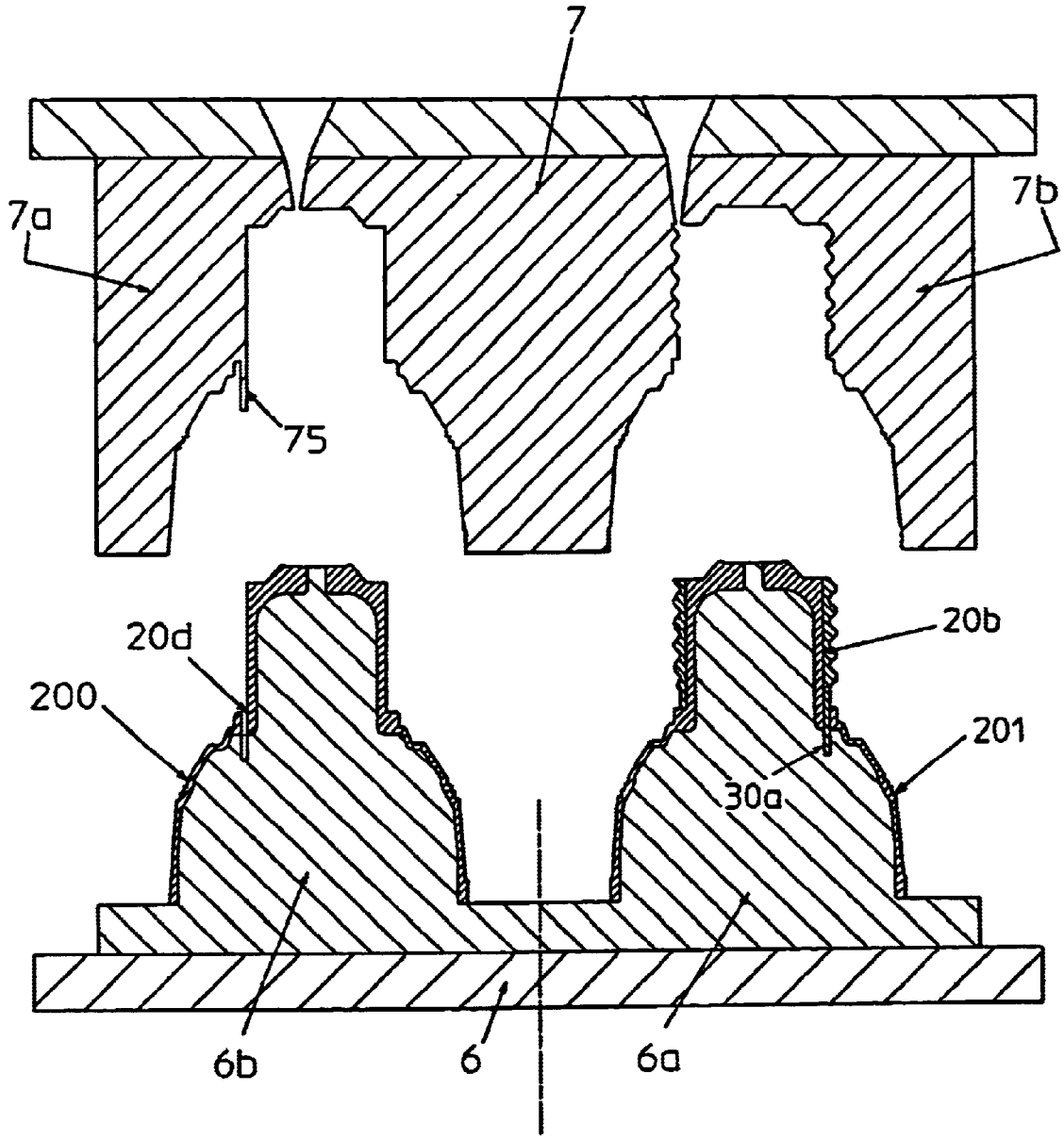
FIG. 11 is a cross sectional view showing a mold opening state in the resin molding secondary process.

As shown in FIG. 11, after the dies are opened, the primary molding 200 formed in the core mold 6*b* is intactly held, and then, a secondary molding 201 formed in the core mold 6*a* is ejected and taken out.

Figure 12:
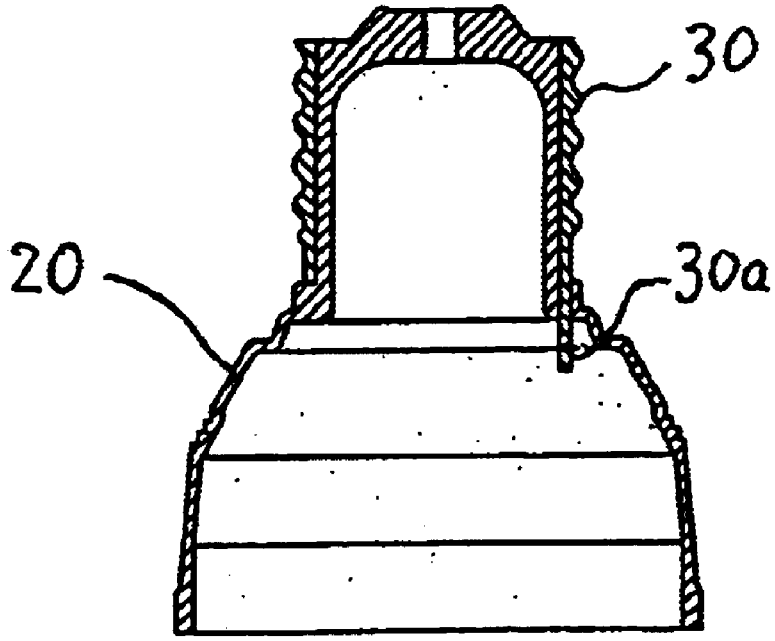
FIG. 12 is a cross sectional view showing a completed lamp case.

By carrying out the above processes, a lamp case as shown in FIG. 12 can be obtained. Thereafter, the core die 6 is again rotated by an angle of 180°, then, the same injection molding shown in FIG. 7 to FIG. 11 is repeatedly carried out, and thereby, the lamp case 20 is successively obtained.

In this case, the cavity die 7 is previously formed with a groove capable of inserting the eyelet 50, and thereafter, molding is performed the eyelet 50 is set in the formed groove, and thereby, the secondary molding 201 can be obtained. The secondary molding 201 thus obtained is molded as the lamp case 20, which is molded integrally with the eyelet 50 as shown in FIG. 1.

In the lamp case 20 manufactured in the above manner, the whole of conductive resin shell 30 is formed out of a conductive resin; therefore, it is possible to make an electrical connection of incandescent lamp like the lamp cap made of metal. Moreover, the conductive resin shell 30 has the threaded portion 31 at its outer periphery; therefore, it is possible to screw the shell 30 into a socket like the conventional case. In addition, the primary molding 200 is formed with the electrode leading hole 20*d*, and the conductive resin is exposed from the electrode leading hole 20*d* in the primary molding 200 so as to function as that the terminal connective portion 30*a*. Therefore, it is possible to readily make a connection with the electrode terminal 40 of the lighting circuit 14 via the terminal connective portion 30*a*, and thereby, the conductive resin shell 30 can perform the same function as the conventional metal shell 5*c*. As described above, in the secondary process, the second cavity mold 7*b* on the secondary molding 201 side is fitted into the core mold 6*a* holding the primary molding 200; therefore, there is no need of taking out the primary molding 200 and mounting it to a mold. As a result, the secondary process can be simplified. Moreover, the threaded cylinder cavity 8*c* is formed by the second cavity mold 7*b*, and then, the conductive resin, that is, the molten resin material R2 is injected and filled into the cavity 8*c*, and thereby, the shell equivalent to the conventional metal shell 5*c* can be formed out of the conductive resin. By doing so, the conventional lamp cap 5 is unnecessary; therefore, there is no need of carrying out a process for mounting the conventional lamp cap 5 to the lamp case 25. In addition, the above primary and secondary processes are carried out by the two color molding process, and thereby, it is possible to manufacture the lamp case 20 which is molded integrally with the conductive resin shell 30 at one-time molding cycle. As a result, productive efficiency can be more improved.

In the above embodiment, the above primary and secondary processes have been carried out by the two color molding process. These primary and secondary processes may be carried out by insert molding of independently carrying out each process. Moreover, the method of the present invention is not limited to the lamp case 20 having the bowl-like portion 20*a*, the cylinder portion 20*b* and the distal portion 20*c* shown in the above embodiment, and is applicable to a cylindrical lamp case having no bowl-like portion 20*a*. In addition the terminal connective portion 30*a* may be of course formed anywhere in the lamp case 20 so long as it is connected to the conductive resin forming the conductive resin shell 30.

(Other manufacturing method)

The above manufacturing method (FIG. 7 to FIG. 11) has been applied to the case of the structure in which the terminal connective portion 30*a* of the conductive resin shell 30 is inserted into the lamp case 20, and is molded so as to be directly connected with the electrode terminal 40 of the lighting circuit 14. The following is a description on the case where the metal terminal 43 is buried in the conductive resin shell 33 as shown in FIG. 4. The molding method is the substantially same as the above molding method, and differs in the following points. More specifically, after the above primary process, the dies are opened, and then, a terminal insertion process is carried out such that the metal terminal 43 is inserted into the electrode leading hole 20*d* of the primary molding 200 so as to be inserted and fixed in the recess portion 76 of the core mold. Then, the secondary process is carried out in the same manner as the above method, and thereby, the lamp case 22 inserting the metal terminal 43 can be molded. By doing so, the lamp case 22 shown in FIG. 4 is obtained.

Moreover, in the case of manufacturing the lamp case 21 shown in FIG. 3, the following improvement is made in place of providing the protrusion 75 of the first cavity mold 7*a* and the recess portion 76 of the core molds 6*a* and 6*b*. More specifically, these core molds 6*a* and 6*b* are individually formed with a protrusion corresponding to the gap 21*e* formed in the cylinder portion 21*b* of the lamp case 21, and thereafter, the above primary and secondary processes are carried out.

The above embodiment has described the case of compact self-ballasted fluorescent lamp. The present invention is not limited to this embodiment, and is applicable to various bulb-form lamps using a lamp cap of a general incandescent lamp, a reflector lamp, a high pressure discharge lamp or the like.

What is claimed is:

1. A bulb-form lamp comprising:

an arc tube;

a lighting circuit for lighting the arc tube;

a lamp case receiving the lighting circuit; and a lamp cap mounted outside the lamp case and functioning as an electrode of the lighting circuit, a threaded portion of the lamp cap, that is, a shell being made of a conductive resin.

2. The bulb-form lamp according to claim 1, wherein the conductive resin shell is a composite part, which is molded integrally with the lamp case.

3. The bulb-form lamp according to claim 1, wherein the conductive resin shell and an eyelet constituting a distal portion of the lamp cap are composite parts, which are molded integrally with the lamp case.

4. The bulb-form lamp according to claim 1, wherein a part of the conductive resin shell is provided with a terminal connective portion projecting into the lamp case, and the terminal connective portion is connected with the lighting circuit so that the conductive resin shell and the lighting circuit are electrically connected.

5. The bulb-form lamp according to claim 4, wherein the terminal connective portion is connected with an electrode terminal led out of a printed circuit board of the lighting circuit.

6. The bulb-form lamp according to claim 1, wherein a part of metal terminal buried in the conductive resin shell is exposed in the lamp case, and the part of metal terminal is connected with the lighting circuit so that the conductive resin shell and the lighting circuit are electrically connected.

7. The bulb-form lamp according to claim 1, wherein a metal eyelet constituting a distal portion of the lamp cap is fitted into a through hole formed at the lamp case distal portion.

8. The bulb-form lamp according to claim 5, wherein a metal eyelet constituting a distal portion of the lamp cap is fitted into a through hole formed at the lamp case distal portion.

9. A manufacturing method of a lamp case receiving a lighting circuit for lighting an arc tube of bulb-form lamp and having a lamp cap functioning as an electrode of the lighting circuit and mounted outside the lamp case, comprising the following steps of:

a primary process; and a secondary process, the primary process including the steps of:

closing a first cavity mold, which is formed along an outer profile of the lamp case and is provided with a protrusion at a shell of being a threaded portion of the lamp cap, and a core mold, which is formed along an inner profile of the lamp case and is provided with a recess portion capable of inserting the protrusion;

forming a cylindrical cavity along the profile of the lamp case;

injecting a molten resin into the cylindrical cavity; and forming a primary molding which is formed with a hole leading electrode by the protrusion, the secondary process including the steps of:

opening the dies;

fitting a second cavity mold provided with a threaded cylinder forming surface into the core mold holding the primary molding;

forming a threaded cylinder cavity including the hole leading electrode at an outer peripheral surface of the shell;

injecting a molten conductive resin into the threaded cylinder cavity so that a part of the conductive resin is molded integrally with a shell, which is provided with a terminal connective portion projected into the lamp case, via the hole.

10. A manufacturing method of a lamp case receiving a lighting circuit for lighting an arc tube of bulb-form lamp and having a lamp cap functioning as an electrode of the lighting circuit and mounted outside the lamp case, comprising the following steps of:

a primary process;

a terminal insertion process; and a secondary process, the primary process including the steps of:

closing a first cavity mold, which is formed along an outer profile of the lamp case and is provided with a protrusion at a shell of being a threaded portion of the lamp cap, and a core mold, which is formed along an inner profile of the lamp case and is provided with a recess portion capable of inserting the protrusion;

forming a cylindrical cavity along the profile of the lamp case;

injecting a molten resin into the cylindrical cavity; and forming a primary molding which is formed with a hole leading electrode by the protrusion, the terminal insertion process including the steps of:

opening the dies; and inserting a metal terminal into the electrode leading hole of the primary molding so that the metal terminal is inserted and fixed into a recess portion of the core mold, the secondary process including the steps of:

fitting a second cavity mold provided with a threaded cylinder forming surface into the core mold holding the primary molding;

forming a threaded cylinder cavity including a part of the metal terminal at an outer peripheral surface of the shell;

injecting a molten conductive resin into the threaded cylinder cavity so that a part of the metal terminal is molded integrally with a shell, which is provided with a terminal connective portion projected into the lamp case, via the hole.

11. The manufacturing method of a lamp case according to claim 9, wherein the primary process further includes a step of forming a through hole capable of fitting an eyelet constituting the distal portion of the lamp cap therein at the distal portion of the primary molding, and forming a recess portion for preventing the eyelet from coming off at the surroundings of the through hole.

12. The manufacturing method of a lamp case according to claim 10, wherein the primary process further includes a step of forming a through hole capable of fitting an eyelet constituting the distal portion of the lamp cap therein at the distal portion of the primary molding, and forming a recess portion for preventing the eyelet from coming off at the surroundings of the through hole.

13. The manufacturing method of a lamp case according to claim 9, wherein the primary and secondary processes are carried out by a two color molding process.

14. The manufacturing method of a lamp case according to claim 10, wherein the primary and secondary processes are carried out by a two color molding process.

15. The manufacturing method of a lamp case according to claim 11, wherein the primary and secondary processes are carried out by a two color molding process.

16. The bulb-form lamp according to claim 1, wherein the conductive resin shell is a composite part, which is injection molded integrally with the lamp case.

17. The bulb-form lamp according to claim 1, wherein the conductive shell and an eyelet constituting a distal portion of the lamp cap are composite parts, which are injected molded integrally with the lamp case.

* * * * *